US007947151B2

(12) United States Patent
Tamai et al.

(10) Patent No.: US 7,947,151 B2
(45) Date of Patent: May 24, 2011

(54) SOFTENING AGENT FOR PAPER AND METHOD FOR MAKING PAPER BY USING SAME

(75) Inventors: Tetsuya Tamai, Amagasaki (JP); Kazumichi Asakura, Amagasaki (JP); Yasuyuki Nakamura, Amagasaki (JP); Takashi Matsufuji, Amagasaki (JP)

(73) Assignee: NOF Corporation (JP)

( * ) Notice: Subject to any disclaimer, the term of this patent is extended or adjusted under 35 U.S.C. 154(b) by 522 days.

(21) Appl. No.: 12/278,305

(22) PCT Filed: Feb. 15, 2007

(86) PCT No.: PCT/JP2007/052682

§ 371 (c)(1), (2), (4) Date: Aug. 5, 2008

(87) PCT Pub. No.: WO2007/094388

PCT Pub. Date: Aug. 23, 2007

(65) Prior Publication Data

US 2009/0014139 A1 Jan. 15, 2009

(30) Foreign Application Priority Data

Feb. 15, 2006 (JP) ..... 2006-038560
Feb. 22, 2006 (JP) ..... 2006-045769

(51) Int. Cl.

| | |
|---|---|
| ***D21H 17/07*** | (2006.01) |
| ***D21H 17/14*** | (2006.01) |
| ***D21H 21/14*** | (2006.01) |
| ***C07C 233/05*** | (2006.01) |

(52) U.S. Cl. ..... 162/158; 162/185; 554/51; 564/123; 564/152

(58) Field of Classification Search ..... 162/158, 162/185; 554/51; 561/123, 152
See application file for complete search history.

(56) References Cited

U.S. PATENT DOCUMENTS

| | | | | |
|---|---|---|---|---|
| 2,438,200 | A * | 3/1948 | Schreiber et al. | 564/160 |
| 2,653,898 | A * | 9/1953 | Castillo et al. | 514/408 |
| 4,264,516 | A * | 4/1981 | Hiestand | 554/41 |
| 5,117,058 | A * | 5/1992 | Chen et al. | 564/157 |
| 2003/0198653 | A1 * | 10/2003 | Walele et al. | 424/401 |

FOREIGN PATENT DOCUMENTS

| | | | | |
|---|---|---|---|---|
| JP | 53-147803 | A | | 12/1978 |
| JP | 60-139897 | A | | 7/1985 |
| JP | 63-165597 | A | | 7/1988 |
| JP | 64-6210 | A | * | 1/1989 |
| JP | 04-100995 | A | | 4/1992 |
| JP | 06-257098 | A | | 9/1994 |
| JP | 07-018571 | A | | 1/1995 |
| JP | 07-189170 | A | | 7/1995 |
| JP | 07-189171 | A | | 7/1995 |
| JP | 2001-355197 | A | | 12/2001 |
| JP | 2002-129497 | A | | 5/2002 |
| JP | 2003-096695 | A | | 4/2003 |
| JP | 2004-285521 | A | | 10/2004 |
| JP | 2005-068592 | A | | 3/2005 |
| JP | 2005-082949 | A | | 3/2005 |
| JP | 2006097183 | A | * | 4/2006 |

* cited by examiner

*Primary Examiner* — Eric Hug
*Assistant Examiner* — Dennis Cordray
(74) *Attorney, Agent, or Firm* — Akerman Senterfitt

(57) ABSTRACT

A paper softening composition that is capable of providing paper with excellent flexibility while suppressing decrease in paper strength. The paper softening composition contains a specific diamide diamine compound or a salt thereof and a specific amide amine compound or a salt thereof in a mass ratio of 5/95 to 90/10.

2 Claims, No Drawings

SOFTENING AGENT FOR PAPER AND METHOD FOR MAKING PAPER BY USING SAME

This application is a 371 of PCT/JP2007/052682, filed Feb. 15, 2007 and claims priority to Japanese Application Nos. 2006-038560, filed Feb. 15, 2006 and 2006-045769, filed Feb. 22, 2006.

TECHNICAL FIELD

The present invention relates to a paper softening composition and a method for manufacturing paper using the paper softening composition. More particularly, the invention relates to a paper softening composition capable of imparting excellent flexibility to paper without decreasing the paper strength and to a method for manufacturing paper using the paper softening composition.

BACKGROUND ART

In recent years, in paper-making industry, soft and pliable printing papers, or papers having excellent flexibility, have been demanded to make it easier to turn printed matter such as books. Also soft and pliable papers comfortable to use have been demanded for sanitary papers, such as tissue papers and toilet tissues.

Patent Document 1 discloses a paper softening composition comprising lanolin or a lanolin derivative. Patent Document 2 discloses a paper softening composition comprising a urethane alcohol or a cationized product thereof as an effective component. Patent Document 3 discloses a paper softening composition comprising pyrrolidone carboxylic acid or a salt thereof. These paper softening compositions, however, do not impart sufficient flexibility to paper.

Patent Document 4 discloses a method for manufacturing softened tissue paper, wherein a di-long-chain alkyl quaternary ammonium salt is added to pulp slurry. Patent Document 5 discloses a paper softening composition comprising a di-long-chain alkyl quaternary ammonium salt, glycerol, and water or an alcohol having four or less carbon atoms. Patent Document 6 discloses a paper softening composition comprising a long-chain alkyl quaternary ammonium salt, an unsaturated fatty acid having 8 to 24 carbon atoms, and an ester of a fatty acid and pentaerythritol. However, although these softening agents impart a certain degree of flexibility to paper, they decreases the paper strength significantly.

In order to solve the problem of low paper strength, Patent Document 7 discloses a paper softening composition containing a water-soluble, heat-reactive urethane resin as an essential component. Patent Document 8 discloses a paper-quality improver containing a compound produced by reacting a polyalkyleneimine with an alkylene oxide and a higher fatty acid. The softener and the paper-quality improver, however, do not impart sufficient flexibility to paper. Patent Document 9 discloses a paper softening composition comprising an amino-ammonium salt. This softener, however, do not impart sufficient paper strength.

Therefore, no paper softening composition capable of imparting flexibility to paper without decreasing the paper strength has been obtained.

Patent Document 1: Japanese Laid-Open Patent Publication No. 53-147803

Patent Document 2: Japanese Laid-Open Patent Publication No. 60-139897

Patent Document 3: Japanese Laid-Open Patent Publication No. 7-189170

Patent Document 4: Japanese Laid-Open Patent Publication No. 63-165597

Patent Document 5: Japanese Laid-Open Patent Publication No. 4-100995

Patent Document 6: Japanese Laid-Open Patent Publication No. 7-189171

Patent Document 7: Japanese Laid-Open Patent Publication No. 6-257098

Patent Document 8: Japanese Laid-Open Patent Publication No. 2005-82949

Patent Document 9: Japanese Laid-Open Patent Publication No. 2001-355197

DISCLOSURE OF THE INVENTION

An object of the present invention is to provide a paper softening composition capable of imparting excellent flexibility to paper while minimizing any decrease in paper strength, and a method for manufacturing paper using the paper softening composition.

The present inventors found the fact that a paper softening composition comprising a specific diamide diamine compound or a salt thereof and a specific amide amine compound or a salt thereof in a specific mass ratio imparts excellent flexibility to paper while minimizing any decrease in paper strength, and thereby accomplished the present invention. The specific diamide diamine compound or a salt thereof is represented by formula (1):

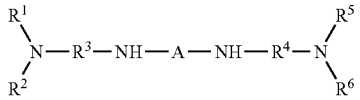

(1)

wherein the chain portion A is a residue of a dicarboxylic acid having 4 to 12 carbon atoms; $R^1$, $R^2$, $R^5$, and $R^6$ are each an alkyl group having 1 to 4 carbon atoms; and $R^3$ and $R^4$ are each an alkylene group having 2 to 4 carbon atoms.

The specific amide amine compound or a salt thereof is represented by formula (2):

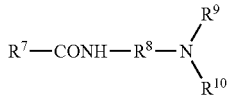

(2)

wherein $R^7CO$ is an acyl group having 10 to 24 carbon atoms; $R^8$ is an alkylene group having 2 to 4 carbon atoms; and $R^9$ and $R^{10}$ are each an alkyl group having 1 to 4 carbon atoms.

The mass ratio of diamide diamine component/amide amine component is in the range of 5/95 to 90/10.

The method for manufacturing paper of the present invention is characterized by adding 0.06 to 8 parts by mass of the above-defined paper softening composition per 100 parts by mass of pulp.

BEST MODE FOR CARRYING OUT THE INVENTION

The paper softening composition of the present invention comprises a diamide diamine compound (DA) or a salt thereof (hereinafter referred to as the diamide diamine component), and an amide amine component (AA) or a salt thereof (hereinafter referred to as the amide amine component). Each of the components, the paper softening composition, and the method for manufacturing paper using the paper softening composition will be described below.

The diamide diamine compound (DA) will now be explained.

The diamide diamine compound (DA) is represented by formula (1) below:

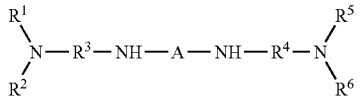

(1)

wherein the chain portion A is a residue of a dicarboxylic acid having 4 to 12 carbon atoms; $R^1$, $R^2$, $R^5$, and $R^6$ are each an alkyl group having 1 to 4 carbon atoms; and $R^3$ and $R^4$ are each an alkylene group having 2 to 4 carbon atoms.

Examples of the dicarboxylic acids include succinic acid, glutaric acid, adipic acid, pimelic acid, suberic acid, azelaic acid, sebacic acid, dodecanedioic acid, maleic acid, fumaric acid, phthalic acid, isophthalic acid, and terephthalic acid. Among these examples, dicarboxylic acids having 6 to 10 carbon atoms are preferable. If the number of carbon atoms exceeds 12, although the paper softening composition containing such a diamide diamine compound may impart flexibility to paper, the resulting diamide diamine compound will have a high melting point, sometimes making it difficult to handle.

In formula (1), examples of $R^1$, $R^2$, $R^5$, and $R^6$ include methyl, ethyl, propyl, isopropyl, butyl, isobutyl, and like groups. Among these examples, methyl and ethyl groups are preferable. If the number of carbon atoms exceeds four, although the paper softening composition containing such a diamide diamine compound may impart flexibility to paper, the resulting diamide diamine compound will have a high melting point, sometimes making it difficult to handle.

In formula (1), examples of $R^3$ and $R^4$ include ethylene, propylene, butylene, and like groups. Among these examples, a propylene group is preferable.

The diamide diamine compound (DA) can be obtained by reacting dialkylaminoalkyleneamine with any of the aforementioned dicarboxylic acids. This reaction is carried out by a normal condensation reaction.

The diamide diamine compound (DA) may be directly blended into the paper softening composition, or may be neutralized with an inorganic or organic acid, and then blended into the paper softening composition as a salt. Neutralization of the diamide diamine compound is preferable because it makes the diamide diamine compound and the paper softening composition easier to handle. Examples of the acid include hydrochloric acid, sulfuric acid, carbonic acid, nitric acid, phosphoric acid, formic acid, acetic acid, propionic acid, butyric acid, glycolic acid, lactic acid, gluconic acid, salicylic acid, hydroxyvaleric acid, aspartic acid, glutamic acid, taurine, and sulfamic acid. Preferable among these examples are formic acid, acetic acid, glycolic acid, lactic acid, and gluconic acid. The amount of the acid used can be suitably adjusted according to the conditions in which the paper softening composition is used, but is preferably equivalent to the amine value of the diamide diamine compound (DA).

The amide amine compound (AA) will now be explained.

In the present invention, the amide amine compound (AA) functions to impart a voluminous feel to paper. The amide amine compound (AA) used in the present invention is represented by formula (2) below:

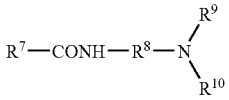

(2)

wherein $R^7CO$ is an acyl group having 10 to 24 carbon atoms; $R^8$ is an alkylene group having 2 to 4 carbon atoms; and $R^9$ and $R^{10}$ are each an alkyl group having 1 to 4 carbon atoms.

In formula (2), $R^7CO$ is an acyl group derived from a Carboxylic acid having 10 to 24 carbon atoms, and examples of such carboxylic acids include capric acid, lauric acid, linderic acid, myristic acid, myristoleic acid, palmitic acid, palmitoleic acid, stearic acid, isostearic acid, oleic acid, linolic acid, linolenic acid, elaidic acid, arachin acid, eicosenic acid, behenic acid, erucic acid, lignoceric acid, and selacholeic acid. These carboxylic acids may be used alone or in a combination of two or more.

In formula (2), examples of $R^8$ include ethylene, propylene, butylene and like groups. Among these examples, a propylene group is preferable.

In formula (2), examples of $R^9$ and $R^{10}$ include methyl, ethyl, propyl, isopropyl, butyl, isobutyl, and like groups. Among these examples, methyl and ethyl groups are preferable, and an ethyl group is particularly preferable.

The amide amine compound (AA) can be obtained by reacting dialkylaminoalkyleneamine with any of the aforementioned carboxylic acids. This reaction is carried out by a usual condensation reaction.

The amide amine compound (AA) may be directly blended into the paper softening composition, or may be neutralized with an inorganic or organic acid, and then blended into the paper softening composition as a salt. Neutralization of the amide amine compound is preferable because it makes the amide amine compound and the paper softening composition easier to handle. Any of the aforementioned acids used in neutralizing the diamide diamine compound (DA) can be used as an acid. The amount of the acid used can be suitably adjusted according to the conditions in which the paper softening composition is used, but is preferably equivalent to the amine value of the amide amine compound (AA).

The paper softening composition will now be explained.

The paper softening composition of the present invention comprises the diamide diamine component (DA component) and the amide amine component (AA component).

In the paper softening composition of the present invention, the mass ratio of DA component to AA component is preferably in the range of 5/95 to 90/10. A paper softening composition in which the mass ratio of DA component to AA component is in the range of 5/95 to 90/10 imparts sufficient flexibility to paper while suppressing any decrease in paper strength. Within this range, the mass ratio of DA component to AA component is preferably adjusted to the range of 10/90 to 35/65, in order to impart further improved flexibility to paper, and the mass ratio of DA component to AA component is preferably adjusted to 50/50 to 85/15, in order to further suppress any decrease in paper strength.

The method for manufacturing paper of the present invention will now be explained.

The method for manufacturing paper of the invention is characterized by the use of the above-described paper softening composition in the manufacture of paper. The paper softening composition is added so that the total amount of DA component and AA component is from 0.06 to 8 parts by mass, and preferably from 0.1 to 4 parts by mass, per 100 parts by mass of pulp. If the total amount of DA component and AA component is less than 0.06 parts by mass, the effect of improving the flexibility may be poor. If the total amount of DA component and AA component exceeds 8 parts by mass, the effect of improving the flexibility commensurate with the amount of the paper softening composition is not obtained, rather leading to an increase in cost and hence an economic disadvantage.

Examples of the pulp (the pulp stock) used include chemical pulps (bleached or unbleached softwood or hardwood pulps of kraft or other types), mechanical pulps (ground pulp, thermomechanical pulp, chemithermomechanical pulp, etc.), deinking pulps (newspapers, magazines, waste papers, etc.), and the like. These pulps may be used alone or in admixture.

The paper softening composition of the present invention can be used in various steps of manufacturing paper. More specifically, the paper softening composition can be added to the paper-making system in any stage of the paper-making process (an internal addition method). The paper softening composition can also be applied to the surface of the pulp sheet obtained by the paper-making process (an external addition method). For example, the internal addition method, in which the paper softening composition is added to pulp slurry in a step, such as a mixing chest, machine chest, stuffbox, or the like, during the paper-making process is employed; alternatively, the external addition method, such as size press, gate roll, spraying, or the like, in which the paper softening composition is applied to the surface of the pulp sheet obtained by the paper-making process is employed.

The internal addition method, in particular, is suitably employed. For example, the paper softening composition is added to a mixture containing pulp and water (for example, pulp slurry), and then paper is manufactured according to a usual process.

In the method for manufacturing paper of the present invention, a paper machine generally used in making paper, such as a fourdrinier machine, a twin wire machine, a Yankee machine, or the like, can be used.

Examples of the present invention, Reference Examples, and Comparative Examples will be described. The invention is not limited to these examples.

Synthesis of Diamide Diamine Compound DA-1

A 500 mL four-necked flask equipped with a stirrer, a condenser tube, a thermometer, and a nitrogen inlet pipe was charged with 204.4 g (2 mol) of amine(dimethylaminopropylamine) and 146.1 g (1 mol) of adipic acid. The mixture was then heated to 180-190° C. while stirring in a nitrogen atmosphere, and reacted for 15 hours while removing the resulting water out of the system, thereby yielding a diamide diamine compound DA-1 with an amine value of 342. See Table 1.

Synthesis of Diamide Diamine Compounds DA-2 to DA-4

Each of diamide diamine compounds DA-2 to DA-4 was obtained according to the same procedure as in synthesis of DA-1, except that the amine (2 mol) and dicarboxylic acid (1 mol) shown in Table 1 were used.

Synthesis of Comparative Diamide Diamine Compound DA'-1

A comparative diamide diamine compound DA'-1 was obtained according to the same procedure as in synthesis of DA-1, except that the amine (2 mol) and dicarboxylic acid (1 mol) shown in Table 1 were used.

TABLE 1

| | raw materials | | | | | | | |
|---|---|---|---|---|---|---|---|---|
| diamide diamine compound | amine | dicarboxylic acid | chain portion A | R1, R2 | R3 | R4 | R5, R6 | amine value |
| DA-1 | dimethylamino-propylamine | adipic acid | adipic acid residue | methyl | propylene | propylene | methyl | 342 |
| DA-2 | diethylamino-ethylamine | sebacic acid | sebacic acid residue | ethyl | ethylene | ethylene | ethyl | 276 |
| DA-3 | diethylamino-propylamine | succinic acid | succinic acid residue | ethyl | propylene | propylene | ethyl | 325 |
| DA-4 | dimethylamino-ethylamine | dodecanedioic acid | dodecanedioic acid residue | methyl | ethylene | ethylene | methyl | 298 |
| comparative DA'-1 | diethylenetri-amine | sebacic acid | sebacic acid residue | — | — | — | — | 144 |

Synthesis of Amide Amine Compound AA-1

A 500 mL four-necked flask equipped with a stirrer, a condenser tube, a thermometer, and a nitrogen inlet pipe was charged with 104.4 g (0.9 mol) of amine(diethylaminoethylamine) and 258.7 g (0.9 mol) of carboxylic acid (stearic acid) as shown in Table 2. The mixture was then heated to 120-130° C. while stirring in a nitrogen atmosphere, and reacted for 15 hours while removing the resulting water out of the system, thereby yielding an amide amine compound AA-1 with an amine value of 151.

Synthesis of Amide Amine Compounds AA-2 to AA-4

Each of amide amine compounds AA-2 to AA-4 was obtained according to the same procedure as in synthesis of AA-1, except that the amine (0.9 mol) and carboxylic acid (0.9 mol) shown in Table 2 were used.

TABLE 2

| | raw materials | | | | | | |
|---|---|---|---|---|---|---|---|
| amideamine compound | amine | carboxylic acid | R7CO | R8 | R9 | R10 | amine value |
| AA-1 | diethylamino-ethylamine | stearic acid | originated from stearic acid | ethylene | ethyl | ethyl | 151 |

TABLE 2-continued

| amideamine compound | raw materials: amine | carboxylic acid | R7CO | R8 | R9 | R10 | amine value |
|---|---|---|---|---|---|---|---|
| AA-2 | dimethylamino-propylamine | mixed fatty acid | originated from mixed fatty acid | propylene | methyl | methyl | 153 |
| AA-3 | diethylamino-propylamine | oleic acid | originated from oleic acid | propylene | ethyl | ethyl | 144 |
| AA-4 | diethylamino-propylamine | isostearic acid | originated from isostearic acid | propylene | ethyl | ethyl | 157 |

(*)mixed fatty acid = 65 mass % of stearic acid + 35 mass % of palmitic acid

Reference Example 1

Preparation of Paper Softening Composition

A 200 mL beaker was charged with 157.8 g of ion exchange water, 0.6 g of acetic acid (equal to one equivalent of the amine value of diamide diamine compound DA-1), and 1.6 g of diamide diamine compound DA-1, and the solution was stirred at 70° C. for 30 minutes to prepare a paper softening composition dispersion of Reference Example 1. The paper softening composition dispersion of Reference Example 1 contained 1.4% by mass of the salt of diamide diamine compound DA-1.

Preparation of Test Sheets

LBKP (bleached hardwood kraft pulp) having a freeness of 400 mL was disintegrated using a disintegrator (manufactured by Kumagai Riki Kogyo Co., Ltd.) to prepare a pulp slurry containing 1% by mass of pulp. 400 g of the resulting pulp slurry (the amount of pulp: 4 g) was placed in a 500 mL beaker, and 4 g of the paper softening composition dispersion of Reference Example 1 (the amount of diamide diamine compound DA-1 was 1.4 parts by mass per 100 parts by mass of pulp) was added. The mixture was then stirred with a turbine blade with a diameter of 4.5 cm at 250 rpm for 1 minute. After stirring, 105 g of the pulp slurry was used to make paper using a TAPPI standard sheet machine (manufactured by Yasuda Seiki Co., Ltd.). The resulting paper was then pressed using an oil hydraulic press (manufactured by Yasuda Seiki Co., Ltd.) at 0.35 Mpa for 5 minutes, and then dried at 105° C. for 2 minutes using a drum-type dryer (manufactured by Yasuda Seiki Co., Ltd.), thereby producing three test sheets with a basis weight of about 50 g/m$^2$. The resulting test sheets were then stored in a room maintained at a constant temperature of 23° C. and a constant humidity of 50% for 17 hours to moisture control.

The thus obtained test sheets were evaluated for their (1) flexibility (bending resistance), (2) voluminous feel, and (3) paper strength.

(1) Evaluation of Flexibility (Bending Resistance)

Using a pure bending tester (KES-FB2, manufactured by Kato Tech, Co., Ltd.), the bending resistance of the portion with a diameter of 155 mm of each of the three test sheets was measured in the longitudinal and lateral directions, and the average value thereof was determined. The resulting average value was evaluated according to the criteria given below. The result is shown in Table 3.

Evaluation Criteria:

A bending resistance of less than $4.41\times10^{-5}$ N·m$^2$/m: good flexibility (○); and A bending resistance of $4.41\times10^{-5}$ N·m$^2$/m or more: poor flexibility (X).

(2) Evaluation of Voluminous Feel

The basis weight of each of the test sheets was measured in accordance with JIS P8124. In addition, thickness was measured for each one of the test sheets at ten points, using a JIS-compliant paper thickness meter MEI-10 (manufactured by Citizen Watch Co., Ltd.), and the average of the ten thicknesses was determined as the thickness of the test sheet. Using the thus obtained basis weight and measured thickness value, the sheet volume V was determined according to the equation below. Next, using test sheets (Comparative Example 1) not containing a paper softening composition, the sheet volume $V_0$ was determined according to the same procedure. Using V and $V_0$, the volume index was calculated based on the equation below, the average of the measurements of the three sheets was determined, and an evaluation was made according to the criteria given below. The results are shown in Table 3.

$$\text{Sheet Volume } V(\text{cm}^3/\text{g}) = \text{thickness}(\mu\text{m})/\text{basis weight}(\text{g}/\text{m}^2)$$

$$\text{Volume index}(\%) = V/V_0\times100$$

Evaluation Criteria:

A volume index of 105% or more: very good voluminous feel (◎);

A volume index of not less than 100% and less than 105%: good voluminous feel (○); and A volume index of less than 100%: poor voluminous feel (X).

(3) Evaluation of Paper Strength

Each test sheet was cut into 15 mm×120 mm, and the tensile strength when the sheet was pulled away was measured using a tensile compression testing machine SV-201-0-SH (manufactured by Imada Seisakusho, Co., Ltd.). The breaking length was then determined from the equation below in accordance with JIS P8113 and evaluated according to the criteria given below. The results are shown in Table 3.

$$\text{Breaking length(km)} = \frac{\text{tensile strength(N)}\times1000}{9.81\times\text{width of test piece(mm)}\times\text{basis weight of test piece(g/m}^2)}.$$

Evaluation Criteria:

A breaking length of 4.3 km or more: sufficient paper strength with a very small decrease in paper strength (○); and A breaking length of less than 4.3 km: poor paper strength with a significant decrease in paper strength (X).

Reference Examples 2 to 4

Each of the paper softening composition dispersions of Reference Examples 2 to 4 was obtained according to the same procedure as in Reference Example 1, using the diamide diamine compound (DA) and acid (equal to one equivalent of the amine value of the diamide diamine compound (DA)) shown in Table 3. The amount of the salt of diamide diamine compound (DA) contained in each of the paper softening composition dispersions of Reference Examples 2 to 4 is shown in Table 3. Using each of the paper softening composition dispersions of Reference Examples 2 to 4, test sheets were produced according to the same procedure as in Reference Example 1, and the resulting test sheets were evaluated. The results are shown in Table 3.

Example 1

A 200 mL beaker was charged with 157.9 g of ion exchange water, 0.5 g of acetic acid (equal to one equivalent of the total amine value of diamide diamine compound DA-1 and amide amine compound AA-1), 1.3 g of diamide diamine compound DA-1, and 0.3 g of amide amine compound AA-1 (the mass ratio of the salt of diamide diamine compound DA-1 to the salt of amide amine compound AA-1 was 85/15), and the solution was stirred at 70° C. for 30 minutes to prepare a paper softening composition dispersion of Example 1. The paper softening composition dispersion of Example 1 contained 1.1% by mass of the salt of diamide diamine compound DA-1. Using the paper softening composition dispersion of Example 1, test sheets were produced according to the same procedure as in Reference Example 1, and the resulting test sheets were evaluated. The results are shown in Table 3.

Examples 2 to 4

Each of the paper softening composition dispersions of Examples 2 to 7 was obtained according to the same procedure as in Reference Example 1, except that the diamide diamine compound (DA) and amide amine compound (AA) of the types and in the mass ratio shown in Table 3 were charged, and the acid (equal to one equivalent of the total amine value of diamide diamine compound (DA) and amide amine compound (AA)) was further added. The amount of the salt of diamide diamine compound (DA) contained in each of the paper softening composition dispersions of Examples 2 to 7 is shown in Table 3. Using each of the paper softening composition dispersions of Examples 2 to 7, test sheets were produced according to the same procedure as in Reference Example 1, and the resulting test sheets were evaluated. The results are shown in Table 3.

Test sheets were produced according to the same procedure as in Example 1, except that the types of amide amine compound (AA) and diamide diamine compound (DA) and the mass ratio thereof were changed, and the resulting test sheets were evaluated. The results are shown in Table 3.

Comparative Example 1

Test sheets were produced according to the same procedure as in Reference Example 1, except that no paper softening composition was added, and the resulting test sheets were evaluated. The results are shown in Table 3.

Comparative Example 2

Test sheets were produced according to the same procedure as in Reference Example 1, except that aqueous solution of 1 mass % distearyldimethylammonium chloride was used as the paper softening composition, and the resulting test sheets were evaluated. The results are shown in Table 3.

Comparative Example 3

Test sheets were produced according to the same procedure as in Reference Example 1, except that ethanol solution of 1 mass % ethylenebisstearamide was used as the paper softening composition, and the resulting test sheets were evaluated. The results are shown in Table 3.

Comparative Example 4

Test sheets were produced according to the same procedure as in Reference Example 1, except that the comparative diamide diamine compound DA'-1 was used, and the resulting test sheets were evaluated. The results are shown in Table 3.

As shown in Table 3, in Examples 1 to 7, test sheets (paper) with less decreases in paper strength and excellent flexibilities were obtained. A favorable voluminous feel had also been imparted to these test sheets (paper).

In contrast, in Comparative Example 1, paper sheets with good flexibility were not obtained because no paper softening composition was used. In Comparative Example 2, paper sheets with sufficient paper strength were not obtained because distearyldimethylammonium chloride was used. In Comparative Example 3, paper sheets with poor flexibility were obtained because a diamide compound (ethylenebisstearamide) different from the diamide diamine compounds (DA) used in the present invention was used. In Comparative Example 4, paper sheets with poor flexibility were obtained because the salt of the amide amine compound consisting of diethylenetriamine and sebacic acid was used. In Reference Example 5, in which the mass ratio of amide amine compound (AA) to diamide diamine compound (DA) fell out of the range of 5/95 to 90/10, the resulting sheets were inferior to those of Examples 1 to 7 in terms of voluminous feel.

TABLE 3

| | paper softening composition dispersion | | | | | | | | | | | | | |
|---|---|---|---|---|---|---|---|---|---|---|---|---|---|---|
| | | | | | | total content of DA and AA salts (%) | flexibility | | | | | paper strength | | |
| | diamide-diamine compound (DA) | amide-amine compound (AA) | mass ratio (DA/AA) | acid | content of DA salt (%) | | bending resistance ($\times 10^{-5}$N · m$^2$/m) | evaluation | voluminous feel | | | breaking length (km) | evaluation | comprehensive evaluation |
| | | | | | | | | | volume (cm$^3$/g) | volume index (%) | evaluation | | | |
| Reference Example 1 | DA-1 | — | 100/0 | acetic acid | 1.4 | 1.4 | 4.25 | ○ | 1.55 | 101.3 | ○ | 5.2 | ○ | ○ |

TABLE 3-continued

| | paper softening composition dispersion | | | | | | flexibility | | | | | paper strength | | |
|---|---|---|---|---|---|---|---|---|---|---|---|---|---|---|
| | diamide-diamine compound (DA) | amide-amine compound (AA) | mass ratio (DA/AA) | acid | content of DA salt (%) | total content of DA and AA salts (%) | bending resistance ($\times 10^{-5}$N · m$^2$/m) | evaluation | voluminous feel volume (cm$^3$/g) | volume index (%) | evaluation | breaking length (km) | evaluation | comprehensive evaluation |
| Reference Example 2 | DA-2 | — | 100/0 | acetic acid | 1.3 | 1.3 | 4.26 | ○ | 1.56 | 102.0 | ○ | 5.3 | ○ | ○ |
| Reference Example 3 | DA-3 | — | 100/0 | formic acid | 1.3 | 1.3 | 4.29 | ○ | 1.58 | 103.3 | ○ | 5.4 | ○ | ○ |
| Reference Example 4 | DA-4 | — | 100/0 | acetic acid | 1.3 | 1.3 | 4.28 | ○ | 1.55 | 101.3 | ○ | 5.3 | ○ | ○ |
| Reference Example 5 | DA-1 | AA-2 | 98/2 | acetic acid | 1.3 | 1.4 | 4.24 | ○ | 1.56 | 102.0 | ○ | 5.2 | ○ | ○ |
| Example 1 | DA-1 | AA-1 | 85/15 | acetic acid | 1.1 | 1.3 | 4.23 | ○ | 1.65 | 107.8 | ◎ | 4.9 | ○ | ◎ |
| Example 2 | DA-2 | AA-2 | 65/35 | acetic acid | 0.8 | 1.2 | 4.23 | ○ | 1.68 | 109.8 | ◎ | 4.7 | ○ | ◎ |
| Example 3 | DA-1 | AA-3 | 55/45 | formic acid | 0.7 | 1.2 | 4.22 | ○ | 1.68 | 109.8 | ◎ | 4.7 | ○ | ◎ |
| Example 4 | DA-2 | AA-4 | 75/25 | acetic acid | 1.0 | 1.3 | 4.20 | ○ | 1.67 | 109.2 | ◎ | 4.9 | ○ | ◎ |
| Example 5 | DA-3 | AA-2 | 70/30 | acetic acid | 0.9 | 1.3 | 4.23 | ○ | 1.68 | 109.8 | ◎ | 4.7 | ○ | ◎ |
| Example 6 | DA-4 | AA-3 | 60/40 | acetic acid | 0.8 | 1.2 | 4.23 | ○ | 1.70 | 111.1 | ◎ | 4.7 | ○ | ◎ |
| Example 7 | DA-1 | AA-4 | 45/55 | acetic acid | 0.6 | 1.3 | 4.18 | ○ | 1.69 | 110.5 | ◎ | 4.4 | ○ | ◎ |
| Comparative Example 1 | none | | | | — | — | 4.52 | X | 1.53 | 100.0 | ○ | 4.9 | ○ | X |
| Comparative Example 2 | distearyldimethylammonium chloride | | | | — | — | 4.38 | ○ | 1.57 | 102.6 | ○ | 3.2 | X | X |
| Comparative Example 3 | ethylenebisstearamide | | | | — | — | 4.51 | X | 1.53 | 100.0 | ○ | 4.8 | ○ | X |
| Comparative Example 4 | DA'-1 | — | 100/0 | acetic acid | — | — | 4.54 | X | 1.51 | 98.7 | X | 5.0 | ○ | X |

Synthesis of Diamide Diamine Compound DA-5

A 500 mL four-necked flask equipped with a stirrer, a condenser tube, a thermometer, and a nitrogen inlet pipe was charged with 146.1 g (1 mol) of adipic acid and 260.0 g (2 mol) of amine(diethylaminopropylamine), as shown in Table 4. The mixture was then heated to 120-130° C. while stirring in a nitrogen atmosphere, and reacted for 15 hours while removing the resulting water out of the system, thereby yielding a diamide diamine compound DA-5 with an amine value of 299.

Synthesis of Diamide Diamine Compounds DA-6 and DA-7

Each of diamide diamine compounds DA-6 and DA-7 was obtained according to the same procedure as in synthesis example 1.5, except that the dicarboxylic acid (1 mol) and amine (2 mol) shown in Table 4 were used.

Synthesis of Amide Amine Compound AA-5

A four-necked flask equipped with a stirrer, a condenser tube, a thermometer, and a nitrogen inlet pipe was charged with 252.0 g (0.9 mol) of carboxylic acid (oleic acid) and 91.8 g (0.9 mol) of amine (dimethylaminopropylamine), as shown in Table 5. The mixture was then heated to 120-130° C. while stirring in a nitrogen atmosphere, and reacted for 15 hours while removing the resulting water out of the system, thereby yielding an amide amine compound AA-5 with an amine value of 149.

Synthesis of Amide Amine Compounds AA-6 to AA-9

Each of amide amine compounds AA-6 to AA-9 was obtained according to the same procedure as in synthesis example 2.5, except that the carboxylic acid (0.9 mol) and amine (0.9 mol) shown in Table 5 were used.

TABLE 4

| | raw materials | | | | | | | |
|---|---|---|---|---|---|---|---|---|
| diamidediamine compound | amine | dicarboxylic acid | chain portion A | R1, R2 | R3 | R4 | R5, R6 | amine value |
| DA-5 | diethylamino-propylamine | adipic acid | adipic acid residue | ethyl | propylene | propylene | ethyl | 299 |
| DA-6 | diethylamino-ethylamine | suberic acid | suberic acid residue | ethyl | ethylene | ethylene | ethyl | 287 |
| DA-7 | dimethylamino-propylamine | sebacic acid | sebacic acid residue | methyl | propylene | propylene | methyl | 291 |

Synthesis of Comparative Amide Amine Compound AA'-1

A comparative amide amine compound AA'-1 was obtained according to the same procedure as in synthesis example 2.5, except that the carboxylic acid (0.9 mol) and amine (0.9 mol) shown in Table 5 were used.

Evaluation Criteria:

A bending resistance of less than $5.68\times10^{-5}$ N·m$^2$/m: good flexibility (○); and A bending resistance of $5.68\times10^{-5}$ N·m$^2$/m or more: poor flexibility (X).

TABLE 5

| amideamine | raw materials | | | | | | amine |
|---|---|---|---|---|---|---|---|
| compound | amine | carboxylic acid | R7CO | R8 | R9 | R10 | value |
| AA-5 | dimethylamino-propylamine | oleic acid | originated from oleic acid | propylene | methyl | methyl | 149 |
| AA-6 | diethylamino-propylamine | stearic acid | originated from stearic acid | propylene | ethyl | ethyl | 138 |
| AA-7 | dimethylamino-ethylamine | myristic acid | originated from myristic acid | ethylene | methyl | methyl | 182 |
| AA-8 | diethylamino-propylamine | mixed fatty acid (*) | originated from mixed fatty acid | propylene | ethyl | ethyl | 148 |
| AA-9 | diethylamino-ethylamine | erucic acid | originated from erucic acid | ethylene | methyl | methyl | 133 |
| comparative AA'-1 | diethylamino-propylamine | 2-ethylhexanoic acid | originated from 2-ethylhexanoic acid | propylene | ethyl | ethyl | 377 |

(*) mixed fatty acid = 2 mass % of myristic acid + 31 mass % of palmitic acid + 66 mass % of stearic acid + 1 mass % of arachin acid

Reference Example 6

Preparation of Paper Softening Composition

A 200 mL beaker was charged with 158.1 g of ion exchange water, 0.3 g of acetic acid (equal to one equivalent of the amine value of amide amine compound AA-5), and 1.6 g of amide amine compound AA-5, and the solution was stirred at 70° C. for 30 minutes to prepare a paper softening composition dispersion of Reference Example 6. The paper softening composition dispersion of Reference Example 6 contained 1.2% by mass of the salt of amide amine compound AA-5.

Preparation of Test Sheets

LBKP (bleached hardwood kraft pulp) having a freeness of 450 mL was disintegrated with a disintegrator (manufactured by Kumagai Riki Kogyo Co., Ltd.) to prepare a pulp slurry containing 1% by mass of pulp. 400 g of the resulting pulp slurry (the amount of pulp: 4 g) was placed in a 500 mL beaker, and 2 g of the paper softening composition dispersion of Reference Example 6 (the amount of the salt of amide amine compound AA-5 was 0.6 parts by mass per 100 parts by mass of pulp) was added. The mixture was then stirred with a turbine blade with a diameter of 4.5 cm at 250 rpm for 1 minute. After stirring, 105 g of the pulp slurry was used to make paper using a TAPPI standard sheet machine (manufactured by Yasuda Seiki Co., Ltd.). The resulting paper was then pressed using an oil hydraulic press (manufactured by Yasuda Seiki Co., Ltd.) at 0.35 Mpa for 5 minutes, and then dried at 105° C. for 2 minutes using a drum-type dryer (manufactured by Yasuda Seiki Co., Ltd.), thereby producing three test sheets with a basis weight of 60 g/m$^2$. The resulting test sheets were then stored for 17 hours at room temperature (23° C.) in an air-conditioned room at 50% humidity.

The thus obtained test sheets were evaluated for their (1) flexibility (bending resistance) and (2) tensile strength.

(1) Evaluation of Bending Flexibility (Bending Resistance)

Using a pure bending tester (KES-FB2, manufactured by Kato Tech, Co., Ltd.), the bending resistance of the portion with a diameter of 155 mm of each of the three test sheets was measured in the longitudinal and lateral directions, and the average value thereof was determined. The resulting average value was evaluated according to the criteria given below. The result is shown in Table 6.

(2) Evaluation of Tensile Strength

Three, 120 mm×15 mm test specimens were cut from each one of the test sheets, and the tensile strength when the sheet was pulled away was measured using a tensile compression testing machine SV-201-0-SH (manufactured by Imada Seisakusho, Co., Ltd.). The breaking length was then calculated in accordance with JIS P8113, as explained above, and the average of the measurements of the three sheets was determined. Next, the breaking length of test sheets prepared without the addition of a paper softening composition (Comparative Example 5) was determined according to the same procedure as above. The proportion of the breaking length of the test sheets obtained by adding a paper softening composition relative to the breaking length of the test sheets of Comparative Example 5 (i.e., the ratio of the breaking length to that of Comparative Example 5) was evaluated according to the criteria given below. The results are shown in Table 6.

Evaluation Criteria:

The ratio of the breaking length to that of Comparative Example 5 is 90% or more: very good tensile strength with a very small decrease in paper strength (◎);

The ratio of the breaking length to that of Comparative Example 5 is not less than 80% and less than 90%: good tensile strength with a small decrease in paper strength (○); and The ratio of the breaking length to that of Comparative Example 5 is less than 80%: poor tensile strength with a significant decrease in paper strength (X).

Reference Examples 7 to 11

Each of the paper softening composition dispersions of Reference Examples 7 to 11 was obtained according to the same procedure as in Reference Example 6, using the amide amine compound (AA) and acid (equal to one equivalent of the amine value of the amide amine compound (AA)) shown in Table 6. The amount of the salt of amide amine compound (AA) contained in each of the paper softening composition dispersions of Reference Examples 7 to 11 is shown in Table 6. Using each of the paper softening composition dispersions of Reference Examples 7 to 11, test sheets were then produced according to the same procedure as in Reference Example 6, and the resulting test sheets were evaluated. The results are shown in Table 6.

Example 8

A 200 mL beaker was charged with 158.2 g of ion exchange water, 0.3 g of acetic acid (equal to one equivalent of the total amine value of amide amine compound AA-5 and diamide diamine compound DA-5), 1.4 g of amide amine compound AA-5, and 0.1 g of diamide diamine compound DA-5 (the mass ratio of amide amine compound AA-5 to diamide diamine compound DA-5 was 90/10), and the solution was stirred at 70° C. for 30 minutes to prepare a paper softening composition dispersion of Example 8. This paper softening composition dispersion contained 1.1% by mass of the salt of amide amine compound AA-5. Using the paper softening composition dispersion of Example 8, test sheets were then produced according to the same procedure as in Reference Example 6, and the resulting test sheets were evaluated. The results are shown in Table 6.

Examples 9 to 13

Each of the paper softening composition dispersions of Examples 9 to 13 was obtained according to the same procedure as in Reference Example 6, except that amide amine compound (AA) and diamide diamine compound (DA) were charged in the mass ratio shown in Table 6, and the acid (equal to one equivalent of the total amine value of amide amine compound (AA) and diamide diamine compound (DA)) was further added. The amount of the salt of amide amine compound (AA) contained in each of the paper softening composition dispersions of Examples 9 to 13 is shown in Table 6. Using each of the paper softening composition dispersions of Examples 9 to 13, test sheets were produced according to the same procedure as in Reference Example 6, and the resulting test sheets were evaluated. The results are shown in Table 6.

Comparative Example 5

Test sheets were produced according to the same procedure as in Reference Example 6, except that no paper softening composition was added, and the resulting test sheets were evaluated. The results are shown in Table 6.

Comparative Example 6

Test sheets were produced according to the same procedure as in Reference Example 6, except that a 1 mass % ethanol solution of stearamide was used as the paper softening composition, and the resulting test sheets were evaluated. The results are shown in Table 6.

Comparative Example 7

Test sheets were produced according to the same procedure as in Reference Example 6, except that the comparative amide amine compound AA'-1 was used as the paper softening composition, and the resulting test sheets were evaluated. The results are shown in Table 6.

Comparative Example 8

Test sheets were produced according to the same procedure as in Reference Example 6, except that diethylenetriamine bisstearoamide neutralized with acetic acid was used as the paper softening composition, and the resulting test sheets were evaluated. The results are shown in Table 6.

As shown in Table 6, it is seen that when the paper softening compositions of Reference Examples 6 to 11 were used, all of the resulting paper sheets (test sheets) exhibited excellent bending flexibility. In addition, when the paper softening compositions of Examples 8 to 13 were used, test sheets were obtained that exhibited, in addition to excellent bending flexibility, further suppressed decreases in tensile strength.

In contrast, in Comparative Example 5, paper sheets with poor bending flexibility were obtained because no paper softening composition was used. In Comparative Example 6, paper sheets with poor bending flexibility were obtained because stearamide, which was different from the paper softening compositions of the present invention, was used as the paper softening composition. In Comparative Example 7, paper sheets with poor bending flexibility were obtained because a salt of an amide amine compound wherein $R^7CO$ has less than 10 carbon atoms (2-ethylhexanoic acid (C 8)), which was different from the paper softening compositions of the invention, was used. In Comparative Example 8, the paper sheets were favorable in terms of bending flexibility, but had a significantly decreased tensile strength because diethylenetriamine bisstearoamide, which is different from the paper softening compositions of the present invention, was used. In Reference Example 11, in which the mass ratio of amide amine compound (AA) to diamide diamine compound (DA) fell out of the range of 5/95 to 90/10, the paper sheets were favorable in terms of bending flexibility, but were slightly inferior to those in Examples 8 to 13 in tensile strength.

TABLE 6

| | paper softening composition dispersion | | | | | | bending flexibility | | tensile strength | | | |
|---|---|---|---|---|---|---|---|---|---|---|---|---|
| | diamide-diamine compound (DA) | amide-amine compound (AA) | mass ratio (DA/AA) | acid | content of AA salt (%) | total content of DA and AA salts (%) | bending resistance ($\times 10^{-5}$N · m$^2$/m) | evaluation | breaking length (km) | percentage to comparative example 5 (%) | evaluation | comprehensive evaluation |
| Reference Example 6 | — | AA-5 | 0/100 | acetic acid | 1.2 | 1.2 | 5.19 | ○ | 3.8 | 82.6 | ○ | ○ |
| Reference Example 7 | — | AA-6 | 0/100 | acetic acid | 1.1 | 1.1 | 5.23 | ○ | 3.9 | 84.8 | ○ | ○ |
| Reference Example 8 | — | AA-7 | 0/100 | acetic acid | 1.2 | 1.2 | 5.31 | ○ | 3.9 | 84.8 | ○ | ○ |
| Reference Example 9 | — | AA-8 | 0/100 | acetic acid | 1.2 | 1.2 | 5.24 | ○ | 3.8 | 82.6 | ○ | ○ |
| Reference Example 10 | — | AA-9 | 0/100 | formic acid | 1.1 | 1.1 | 5.29 | ○ | 3.8 | 82.6 | ○ | ○ |
| Reference Example 11 | DA-7 | AA-6 | 1/99 | acetic acid | 1.1 | 1.1 | 5.22 | ○ | 4.0 | 87.0 | ○ | ○ |

TABLE 6-continued

| | paper softening composition dispersion | | | | | | bending flexibility | | tensile strength | | | |
|---|---|---|---|---|---|---|---|---|---|---|---|---|
| | diamide-diamine compound (DA) | amide-amine compound (AA) | mass ratio (DA/AA) | acid | content of AA salt (%) | total content of DA and AA salts (%) | bending resistance ($\times 10^{-5}$N · $m^2$/m) | evaluation | breaking length (km) | percentage to comparative example 5 (%) | evaluation | comprehensive evaluation |
| Example 8 | DA-5 | AA-5 | 10/90 | acetic acid | 1.1 | 1.2 | 5.20 | ○ | 4.2 | 91.3 | ◎ | ◎ |
| Example 9 | DA-6 | AA-6 | 30/70 | acetic acid | 0.9 | 1.2 | 5.25 | ○ | 4.3 | 93.5 | ◎ | ◎ |
| Example 10 | DA-7 | AA-8 | 20/80 | formic acid | 0.9 | 1.2 | 5.26 | ○ | 4.3 | 93.5 | ◎ | ◎ |
| Example 11 | DA-5 | AA-7 | 15/85 | acetic acid | 1.0 | 1.1 | 5.28 | ○ | 4.2 | 91.3 | ◎ | ◎ |
| Example 12 | DA-6 | AA-9 | 25/75 | acetic acid | 0.9 | 1.2 | 5.23 | ○ | 4.2 | 91.3 | ◎ | ◎ |
| Example 13 | DA-5 | AA-8 | 40/60 | acetic acid | 0.7 | 1.2 | 5.45 | ○ | 4.3 | 93.5 | ◎ | ◎ |
| Comparative Example 5 | none | | | | — | — | 5.78 | X | 4.6 | 100 | ◎ | X |
| Comparative Example 6 | stearamide | | | | — | — | 5.82 | X | 4.4 | 95.7 | ◎ | X |
| Comparative Example 7 | — | AA'-1 | 0/100 | acetic acid | — | — | 5.75 | X | 4.4 | 95.7 | ◎ | X |
| Comparative Example 8 | diethylenetriamine bisstearoamide | | | acetic acid | — | — | 5.41 | ○ | 3.3 | 71.7 | X | X |

The invention claimed is:

1. A paper softening composition comprising:

a diamide diamine compound or a salt thereof represented by formula (1):

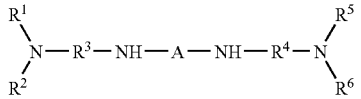

(1)

wherein the chain portion A is a residue of a dicarboxylic acid having 4 to 12 carbon atoms; $R^1$, $R^2$, $R^5$, and $R^6$ are each an alkyl group having 1 to 4 carbon atoms; and $R^3$ and $R^4$ are each an alkylene group having 2 to 4 carbon atoms; and an amide amine compound or a salt thereof represented by formula (2):

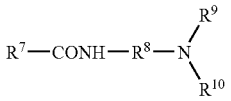

(2)

wherein $R^7CO$ is an acyl group having 10 to 24 carbon atoms; $R^8$ is an alkylene group having 2 to 4 carbon atoms; and $R^9$ and $R^{10}$ are each an alkyl group having 1 to 4 carbon atoms;

the mass ratio of diamide diamine component to amide amine component being in the range of 5/95 to 90/10.

2. A method for manufacturing paper, characterized by adding 0.06 to 8 parts by mass of the paper softening composition according to claim 1 per 100 parts by mass of pulp.

* * * * *